United States Patent [19]

Umezono et al.

[11] 3,957,673

[45] May 18, 1976

[54] SCALE INHIBITOR COMPOSITIONS FOR APPLICATION ONTO METAL SUBSTRATES TO BE HEATED, AND THE METHOD THEREFOR

[75] Inventors: Akimi Umezono; Minoru Kitayama; Susumu Yamaguchi; Hisao Odashima, all of Himeji, Japan

[73] Assignee: Nippon Steel Corporation, Tokyo, Japan

[22] Filed: July 16, 1973

[21] Appl. No.: 379,224

[30] Foreign Application Priority Data

| | | |
|---|---|---|
| July 20, 1972 | Japan | 47-71990 |
| Sept. 4, 1972 | Japan | 47-87985 |
| Oct. 23, 1972 | Japan | 47-105282 |
| May 21, 1973 | Japan | 48-56531 |
| May 21, 1973 | Japan | 48-56532 |

[52] U.S. Cl. ..... 252/178; 21/2.7 R; 106/14; 252/81; 427/344; 427/419

[51] Int. Cl.[2] ..... C02B 5/02

[58] Field of Search ..... 252/178, 81; 210/29, 210/57; 117/135.1, 70; 21/2.7 R; 106/14; 427/344; 429/419

[56] References Cited

UNITED STATES PATENTS

| | | | |
|---|---|---|---|
| 3,556,824 | 1/1971 | Demo | 252/387 |
| 3,620,777 | 11/1971 | Okabe et al. | 252/387 |
| 3,706,603 | 12/1972 | Vessey et al. | 252/387 |
| 3,770,652 | 11/1973 | Gordon | 252/387 |

*Primary Examiner*—Benjamin R. Padgett
*Assistant Examiner*—Irwin Gluck
*Attorney, Agent, or Firm*—Toren, McGeady and Stanger

[57] ABSTRACT

A scale inhibitor composition comprising $Cr_2O_3$, reducing agent, refractory or clay, $SiO_2$ and water glass, and a method of inhibiting the formation of scale on the surfaces of metal substrates to be heated in high temperature atmosphere by application of a coating of the scale inhibitor composition either on the metal surface, or on a subbing layer of a parting agent previously applied on the metal surfaces are disclosed, wherein improvements are effected particularly in both yield and prevention of surface scars.

3 Claims, 7 Drawing Figures

SCALE INHIBITOR COMPOSITIONS FOR APPLICATION ONTO METAL SUBSTRATES TO BE HEATED, AND THE METHOD THEREFOR

In general, steel products are manufactured by rolling steel materials of the form such as slab, beam blank, bloom and the like after heating in a heating furnace at temperatures ranging from 1150° to 1350°C for several hours, the heating conditions depending upon the composition of and the thicknesses of the steel materials. In the heating furnace, however, scale is formed by the heating in amounts usually of 1.5 – 2.0 percent and in the case of steel substrates treated at high temperatures, of 3 – 5 percent, so that some loss in the weight of steel results. Furthermore, when scale fragments are allowed to enter between rolls, the rolled surfaces are damaged with pockmarks.

Conventionally the application of a scale inhibitor coating on the surfaces of steel substrates prior to heating in a heating furnace has been employed for the purpose of inhibiting the formation of scale. In this case, the properties required for the scale inhibitor coating are a capability a maintaining a sufficient antioxidation effect at a high temperature range of 1150° – 1350°C and complete strippability at the time of hot rolling. However, the known scale inhibitors have poor strippabilities at the time of hot rolling, so that some fragments of the scale inhibitor coating left behind on the surfaces of the steel substrates causes the formation of the so-called brick scars or pockmark scars to thereby impair remarkably the value of the steel products.

The present inventors have now succeeded in the formulation of novel scale inhibitor compositions which are formed in low cost and which when applied in simple fashion on the surfaces of steel substrates provides excellent resistances against the scale formation even under heating situations at temperatures higher than 1000°C and particularly higher than 1200°C for a long dwell time. In addition to the resultant antioxidation effect, the present inventors have also succeeded in the achievement of a method for treatment to improve remarkably the strippability of the scale inhibitor coating at the time of hot rolling, and the formulation of parting agent compositions for use in the treatment.

The features of the present invention reside in;

1. A method for preventing scale formation in a high temperature atmosphere which comprises applying scale preventive composition on the surface of metal materials to be heated said scale preventive composition comprising $Cr_2O_3$, reducing agent, refractories or clay, $SiO_2$ and water glass.

2. A method for preventing scale formation in a high temperature atmosphere which comprises applying a parting composition comprising one or more selected from the group consisting of Ba, Ca, Al, Mn, Cr, Cu, Mg, Nb, P, Si, Ti, Zr, Co, Cd, K, Li, Sr, Zn, Na, V, Bi, W and Fe, their oxides, carbonates and compounds and binding agents on the surface of metal material to be heated and applying a scale preventive composition on said parting composition layer.

3. A method for preventing scale formation in high temperature atmosphere which comprises applying a parting composition comprising one or more selected from the group consisting of compounds of $B_4O_7^{--}$, $HB_4O_7^-$, $HSO_4^-$, $SO_4^{--}$, $S_2O_7^{--}$, $HS_2O_7^-$, $P_2O_7^{--}$, $HP_2O_7^-$, $H_2PO_4^-$, $HPO_4^{--}$ and $PO_4^{--}$, and $H_3BO_3$ and $B_2O_3$ on the surface of metal material to be heated and applying a scale preventive composition on said parting composition layer.

4. A method for preventing scale formation in a high temperature atmosphere which comprises applying a parting composition comprising silica powder, magnesia powder, porcelain, montmorillonite $MgO\text{-}Cr_2O_3$ and $MgO\text{-}SiO_2$ refractories or clay on the surface of metal material to be heated, and applying a scale preventive composition on said parting composition layer.

5. A scale preventive composition comprising $Cr_2O_3$ reducing agent refractories or clay, $SiO_2$ and water glass.

6. A scale preventive composition comprising 1 to 20 wt. parts of $Cr_2O_3$, 1 to 20 wt. parts of one or more of Al, Zn, Cu, Ni, Co, Mn, Mg, Fe, Cr, Ti, Zr, Sr, Mo, Sn, In, C, $Fe_3O_4$ and FeO, 5 – 80 wt. parts of one or more of silica powder, porcelain, magnesia powder, montmorillonite, $Mg\text{-}Cr_2O_3$ and $MgO\text{-}SiO_2$ and dolomite refractories or clay, 5 to 120 wt. parts of $SiO_2$ and 5 to 120 wt. parts of water glass.

7. A parting composition comprising one or more of Ba, Cu, Al, Mn, Cr, Cu, Mg, Nb, P, Si, Ti, Zr, Co, Cd, K, Li, Sr, Zn, Na, V, Bi, W, Fe, their oxides, carbonates and compounds.

8. A parting composition comprising silica powder, magnesia powder, porcelain montmorillonite $MgO\text{-}Cr_2O_3$ and $MgO\text{-}SiO_2$ refractories or clay.

This invention will now explained in greater detail with reference to the drawings.

FIG. 1 is a series of curves relating the concentration of each constituent of a scale inhibitor composition in $Cr_2O_3$-Al-kaolin-$SiO_2$-water glass system to the weight loss of steel due to the formation of scale.

FIG. 2 is a curve relating the coating weight to the weight loss of steel due to the formation of scale.

FIG. 3 is curves relating the heating time to the weight loss of steel due to the formation of scale.

FIG. 4 is a graph illustrating the optimum amount of bentonite added.

FIG. 5 is a curve illustrating the drying temperature dependence of the strippability of the water glass-containing scale inhibitor coating after high temperature heat treatment.

FIG. 6 is a sectional view of the water glass-containing scale inhibitor coating dried at a temperature less than 70°C.

FIG. 7 is a sectional view of the coating dried at a temperature higher than 70°C.

The scale inhibitor of the invention consists of $Cr_2O_3$, reducing agent, refractory (or clay), $SiO_2$ and water glass. As the reducing agent, use can be made of Al, Cu, Ni, Co, Mn, Mg, Fe, Cr, Ti, Zr, Sr, Mo, Sn, In, C, FeO, $Fe_3O_4$, and a combination thereof. Of these, Al is the most effective. As the refractory and clay, use can be made of silica powder, magnesia powder, kaolin, montmorillonite, refractories of $MgO\text{-}Cr_2O_3$, $MgO\text{-}BiO_2$ and dolomite type, and a combination thereof. Of these, kaolin and montmorillonite are the most effective.

Figure 1:
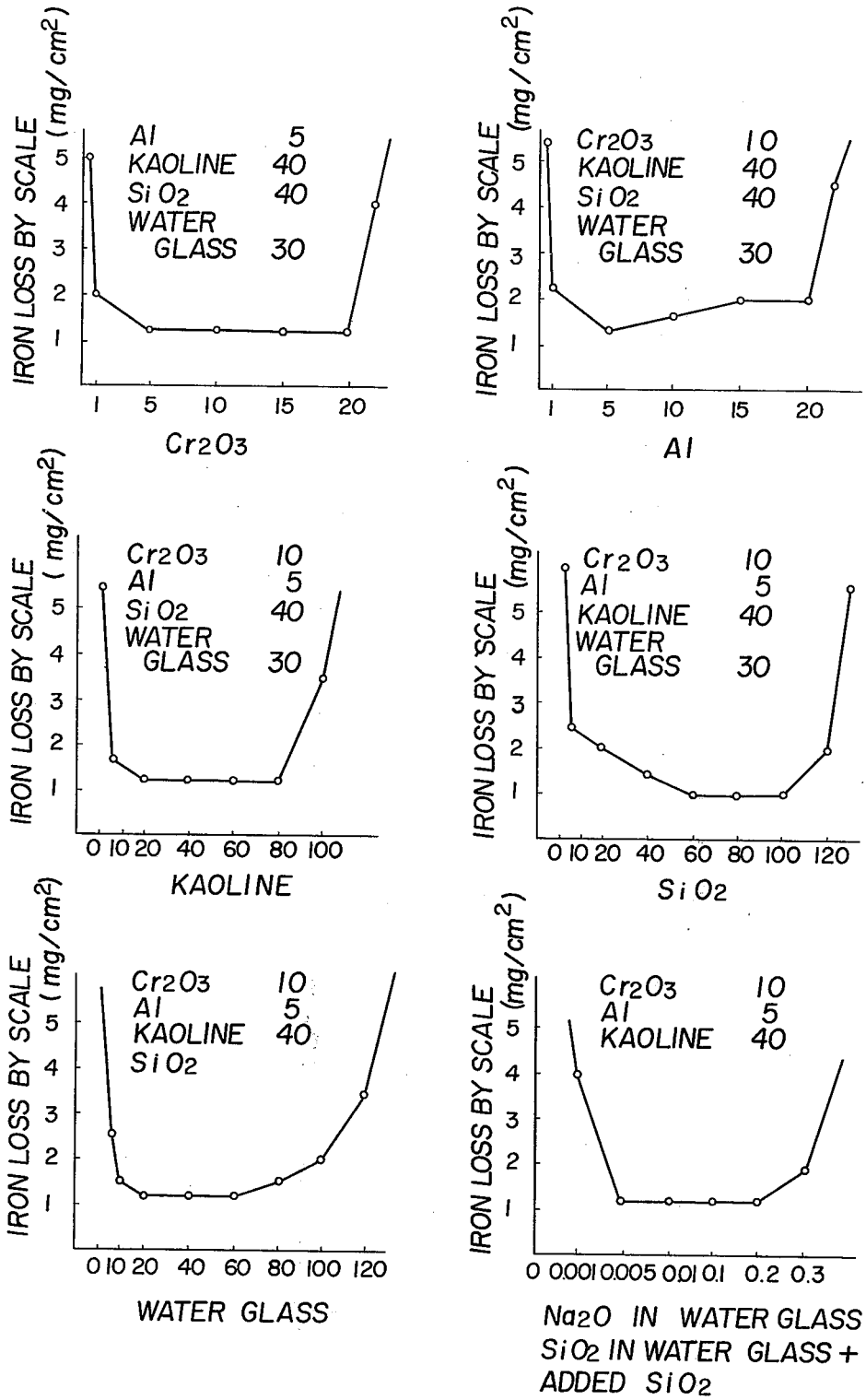
FIGS. 1 – 4 show quantities of scale formed when scale inhibitor compositions of the invention are used.
Figure 2:
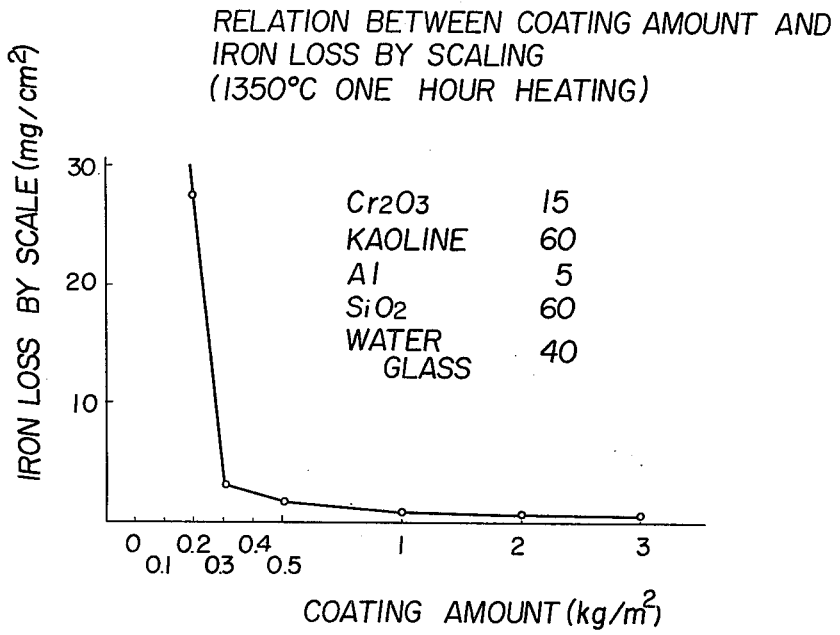

In order to find out the optimum concentration of each constituent thereof, steel substrates were coated with different compositions of the above system and were heated at 1200°C for 2 hours to measure the weight loss of steel. The obtained data are plotted as in the graphs of FIG. 1. It is apparant from FIG. 1 that the optimum compositions are formed by mixing 1 – 20 parts by weight of $Cr_2O_3$, 1 – 20 parts by weight of Al, 5 – 80 parts by weight of kaolin, 5 – 120 parts of by weight of $SiO_2$, and 1 – 120 parts by weight of water glass under the conditions that $$\frac{Na_2O \text{ in water glass}}{SiO_2 \text{ in water glass} + SiO_2} = 0.005 - 0.3$$

In the following description, all parts and percentages are expressed by weight unless otherwise specified.

In this experiment, the weight loss of steel is calculated based on the formula [Weight loss of steel due to the formation of scale] = [Weight of a steel substrate prior to the application of the inhibitor] - [Weight after an electrolytic reduction]. The electrolysis was carried out in 10 percent $H_2SO_4$ for 1 hour at DK = 2A/dm$^2$ using the substrate at the cathode.

Almost similar results are effected when the system is formulated both by substituting the Al as the reducing agent in whole or in part by An, Ni, Co, Mn, Mg, Fe, Cr, Ti, Zr, Sr, Mo, Sn, In, C, FeO, $Fe_3O_5$, or a combination thereof, and by substituting the kaolin as the refractory or clay in whole or in part by magnesia powder, montmorillonite powder, refractories of MgO-$Cr_2O_3$, MgO-$SiO_2$ and dolomite type, or a combination thereof. Therefore, the scale inhibitor composition of the invention may be defined as containing 1 – 20 parts of $Cr_2O_3$, 1 – 20 parts of reducing agents, 5 – 80 parts of refractories (or clays), 5 – 120 parts of $SiO_2$ and 5 – 120 parts of water glass under conditions that $$\frac{Na_2O \text{ in water glass}}{(SiO_2 \text{ in water glass}) + SiO_2} = 0.005 - 0.3$$

Figure 3:
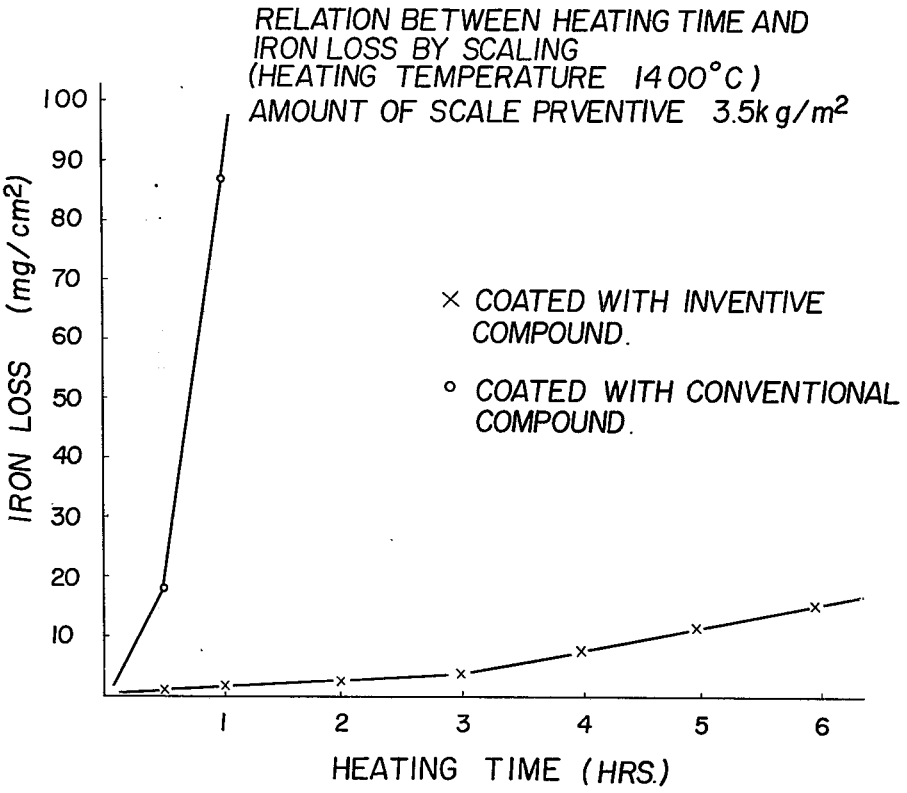

By comparison with a known scale inhibitor available on the market, the scale inhibitor of the invention produces a very large effect when heating in a high temperature range of more than 1000°C for a long time as mentioned above. Particularly under heating conditions of higher than 1200°C, the superiority and effect is remarkable being several tens to several hundreds of times as large as that of the known scale inhibitor, as shown in FIG. 3.

The mechanism by which the compositions of the invention function as a scale inhibitor may be understood as follows. Suppose that a scale inhibitor composition of the invention, for example, in $Cr_2O_3$-Al-kaolin-$SiO_2$-water glass system applied on a steel substrate is heated to temperatures of less than 400° – 450°C, the water glass forms in itself a coating film so intimate that ambient oxygen is not allowed by diffusion to reach the substrate surfaces. At temperatures around 500° – 450°C, the water glass undergoes a transformation, but as the temperature increases further, it becomes again a hard semi-fused coating film, while the increase in the temperature increases the quantity of oxygen diffused, but the oxygen is combined with the reducing agent present in the coating, converting into oxides, so that furter diffusion of oxygen toward the inside is inhibited. At temperatures above 1000°C, the oxygen which is allowed by diffusion to reach the surfaces of the steel substrate enters into combination with the iron to form FeO which is then allowed to react with mainly with $SiO_2$ and $Al_2O_3$ contained in the refractory so that a thin coating film made of semi-fused 2FeO.SiO$_2$, FeO-.$Al_2O_3$, etc., covers the surfaces of the steel substrate, thus inhibiting further diffusion of the oxygen.

A glassy semi-fused coating film is also formed when the kaolin is substituted in while or in part by one of the above-mentioned refractories and clays, inhibiting the diffusion of oxygen. Water glass is usually composed of $Na_2O$ and $SiO_2$, and its viscosity in a high temperature is remarkably different with different mixture ratios of $Na_2O$ and $SiO_2$. For example, the viscosity at 1400°C is 1.0 poise with 2Na$_2$O.SiO$_2$, 1.6 poises with $Na_2O.SiO_2$, 280 poises with $Na_2O$.2SiO$_2$, and to the limit the viscosity of $SiO_2$ alone is $10^{10}$ poises. Therefore, the ratio of $Na_2O$ and $SiO_2$ may be properly selected so that the coating film having such a hardness as to follow the volume expansion of the steel substrate heated up to more than 1000°C without producing any crack therein. Water glass is available on the market under the tradenames of Water glass No. 1, No. 2 and No. 3 which are composed of Na$_2$0.2SiO$_2$, Na$_2$O.2.5SiO$_2$ and Na$_2$O.3SiO$_2$ respectively. The present inventors have found that in order to effect such a hardness, it is necessary to add 5 – 20 parts of $SiO_2$ to 5 – 120 parts of these water glasses to adjust the mixture ratio of $Na_2O$ to $SiO_2$ within the limitations defined by the following equation.

$$\frac{Na_2O \text{ in water glass}}{SiO_2 \text{ in water glass} + \text{additional } SiO_2} = 0.005 - 0.3$$

The amount of $SiO_2$ added to water glass is specified on the basis of this finding.

Figure 4:
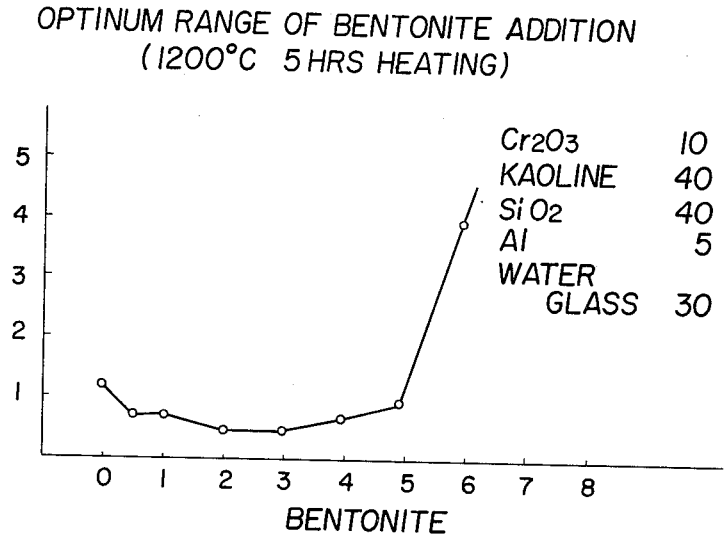

$Cr_2O_3$ is usually available in the form of very fine powder. The addition of such $Cr_2O_3$ powder makes the coating more intimate with the surface so that the inhibitation of scale formation is furthermore promoted. Further, in manufacturing steel materials, almost all of the scale inhibitor coatings which have been applied on slabs and beam blanks in order to inhibit the formation of scale before putting them into heating furnaces must be peeled off during rolling. This peeling-off property is improved by the addition of $Cr_2O_3$ into the composition. When the composition is formulated also to contain a minor amount of bentonite, the strippability is improved and simultaneously the antioxidation effect is furthermore improved. When employed, preferably amounts of bentonite added are 0.5 – 5 parts as is clear from FIG. 4.

The use of the scale inhibitor composition in coating weights of more than 0.3kg/m$^2$ increases the effectiveness of the invention. The present scale inhibitor is effective not only for iron, but also all of the other metals. Further, when materials other than the metals, for example, refractory products are coated therewith, they exhibit excellent heat resistances, and their lives are remarkably increased. As already mentioned, the compositions of the invention produce large effects remarkably superior to those of known compositions when heating at a temperature above 1000°C for a long time (See FIG. 3), the effects being several tenfold as large. In addition, the present compositions provide coating having very good strippability when cooled, or during the heating, so that there is no problems of surface scar to formation due to fragments of the coating left on the surfaces at the time rolling. Further, the present compositions are intended to contain non-pollution materials so that, on heating, no poisonous gasses and bad odor gases are generated, thereby to provide an additional advantage in practicing the invention.

According to the first phase of this invention, the scale inhibitor compositions specified above may be directly applied on the surfaces of metal substrates to be heated, but a sub-layer of a parting agent may be applied. Therefore, the second phase of the present invention relating to a method for treatment using a parting agent and the compositions of the parting agent will be explained herebelow.

is formed. All of these coatings formed between the steel surface and the scale inhibitor coating are very fragile, and they have poor adhesion to the steel surfaces so that the subsequent rolling operation very easily peels off the sub-layer together with the scale inhibitor layer from the surfaces of the steel substrates. The application the under-coating treatment does not damage the desired effect of the scale inhibitor coating.

Preferred combinations of the parting agent for use in applying the sub-layer and preferred coating weights will now be described herebelow.

Table 1 shows a relation of the mixture ratio of $BaCO_3$ and water glass to the strippability of the subbing layer along with a scale inhibitor coating applied thereon.

Table 1

Effect of mixture ratio of $BaCO_3$ and water glass on the strippability when heating at 1250°C.

| $BaCO_3$: water glass (parts by weight) | 10:0.1 | 10:0.5 | 10:1 | 10:2 | 10:4 | 10:10 | 10:15 | 10:20 |
|---|---|---|---|---|---|---|---|---|
| Strippability | O | O | O | O | O | O | Δ | x |

Note 1)
O After passed through a scale breaker peeled off in 100%
Δ After passed through a scale breaker peeled off in 95 – 99%
x After passed through a scale breaker peeled off in less than 95%
Note 2)
The under-coating weight: one mol/m²
The scale inhibitor composition:
in $Cr_2O_3$-reducing agent-refractory-$SiO_2$-water glass system
The amount of the scale inhibitor applied is constant in the samples.

The strippability of the scale inhibitor coating at the time of rolling is remarkably improved by provision of a special sub-treatment under the scale inhibitor coating layer. According to the method for the treatment of the present invention, one or more elements selected from Ba, Ca, Al, Mn, Cr, Cu, Mg, Nb, P, Si, Ti, Zr, Co, Cd, K, Li, Sr, Zn, Na, V, Bi, W, Fe and Fe, or their oxides and carbonates are mixed with a binder, and the mixture is applied on the surfaces of substrates to be heated at a coverage of more than 0.05 mol/m² to form a sub-layer, on which a scale inhibitor coating is applied, so that upon heating of the substrate, an iron compound oxide layer capable of being easily peeled off is formed under the scale inhibitor coating layer.

As the binder, use can be made of water glass, colloidal silica, colloidal silica mixed with minor amounts of $CrO_3$ and/or $Na_2Cr_2O_7$, and water-soluble polymers such as CMC and MC. Suppose that a parting agent coating formulated of, for example, $BaCO_3$ and a binder may be applied on the surfaces of steel substrates, and that a scale inhibitor coating is applied thereon, traces of oxygen diffusing in the scale inhibitor coating and passing through the sub-layer is allowed, upon heating to reach the surfaces of the steel substrate, so that some oxides, such as, FeO, $Fe_2O_3$ and $Fe_3O_4$ are formed. Although the decomposition temperature of $BaCO_3$ is 1450°C, such oxides formed on the steel surfaces permit $BaCO_3$ to easily decompose at far lower temperatures, so that barium is combined with iron oxides to form a coating of the so-called barium ferrate ($BaFeO_4$) between the steel surface and the scale inhibitor coating. In case $TiO_2$ is used instead of $BaCO_3$, the $TiO_2$ is combined with FeO, $Fe_2O_3$ and $Fe_3O_4$ to form a coating of oxides which are called iron titanates ($FeO.TiO_2$, $FeO.2TiO_2$, $2FeO.TiO_2$, $Fe_2O_3.TiO_2$, etc.) When another additive is used, a coating of compounds resulting from the additive and iron oxides As is clear from Table 1, the optimum mixture ratio is less than 10 parts of $BaCO_3$ per 10 parts of water glass. This is because when water glass exceeds 10 parts, the concentration of $BaCO_3$ is decreased with an increase in the adhesion strength between the sub-layer and steel surface, and simultaneously with an increase in the toughness of the sub-layer.

When the amount of water glass added is decreased from 0.1 part, the adhesion tension of the sub-layer applied on the surfaces of slabs or beam blanks becomes weak due to the small concentration of water glass. However, in as much as the scale inhibitor coating can be applied on such a sub-layer, the weakness of the adhesion tension of the sub-layer has essentially no bad influence on the improvement of the strippability of the scale inhibitor coating applied thereon. Table 2 shows a relation of coating weights of a sub-layer consisting of 10 parts of $BaCO_3$ and 2 parts of water glass to the strippability.

Table 2

Effect of coating weights on the strippability when heating at 1250°C

| Coating weight of sub-layer (kg/m²) | 0.01 | 0.05 | 0.1 | 0.5 | 1.0 | 5.0 | 10.0 | 20.0 | 30.0 |
|---|---|---|---|---|---|---|---|---|---|
| Strippability | x | O | O | O | O | O | O | O | O |

Note 1)
The criterion is the same as in the Table 1.
Note 2)
The composition of the scale inhibitor and its coating weight are the same as in Table 1.

As is clear from Table 2, a good result is obtained with coating weights of more than 0.05 mol/m². Therefore, in the invention, the coating weights of the sub-layer are specified as being more than 0.05 mol/m². Larger coating weights can also be employed without reducing the improvement of the strippability, although there is no commercial advantage in so doing, because the under-coating compositions are comparatively expensive. In usual, coating weights of less than 20 – 30 mol/m² are advantageous. In Tables 1 and 2, mixtures of $BaCO_3$ and water glass are representative of the parting agent composition. Similar results are effected by using other compositions.

One experiment was conducted according to the treatment method of the invention in such a manner as shown below. A surface of a slab was divided into three parts, the center part of which was coated with a mixture of $BaCO_3$ and water glass (10 : 2) at a coverage of one mol/m², and a scale inhibitor composition in the system mentioned in Table 1 was then applied thereon. Another part is untreated (bare surface), and the other surface was coated with only the scale inhibitor composition. After being dried, the slab having three different surfaces was heated in a heating furnace at 1250°C for 4 hours and then rolled.

The rolling operation was performed in the procedure from a scale breaker step to a finish rolling step, while removing the scale by means of high pressure water sprays of more than 100 atms before and after each of the scale breaker and finish rolling steps. In this experiment, after the slab had been passed through the scale breaker step, the manner in which the formed scale and the scale inhibitor coating had been peeled off was examined. As a result, some scale fragments were found to be left behind on the untreated surface. On the other hand, on the scale inhibitor-coated surface, almost all of the scale inhibitor coating remained thereon. In contrast to these surfaces, it was found that both the under-coating and over-coating layers had been completely (100percent) peeled off from the surface which had been treated according to the method of the invention.

In the next place, when the slab was subjected to the finish rolling, a great number of surface scars due to the insertion of scale fragments were formed on the untreated surface, while the surface which had been treated according to the treatment method of the invention had no scar and was clean. The surface coated with only the scale inhibitor composition had some brick scars due to the fragments of the scale inhibitor coating, and there were some fragments of the scale inhibitor coatings adhered on the rolls.

As will be seen from this experiment, according to the invention, the scale inhibitor coating can be perfectly peeled off at the time of rolling. Therefore, the number of surface defects due to unremoved fragments of the scale inhibitor coating, and the number of pockmark scars due to the adhesion thereof on the rolls can be decreased largely, as a result of which the cost necessary for finishing the surfaces of the steel substrates can be largely diminished.

The method of treatment using a second parting agent and the composition of the parting agent will be explained hereinbelow.

According to this phase of the invention, one or more compounds having ironic groups selected from $B_4O_7^{--}$, $HB_4O_7^-$, $HSO_4^-$, $SO_4^{--}$, $S_2O_7^{--}$, $HS_2O_7^-$, , $P_2O_7^-$, $HP_2O_7^-$, $H_2PO_4^-$, $HPO_4^{--}$ and $PO_4^{--}$, and $H_3BO_3$ are provided between the surface of a metal substrate to be heated and the scale inhibitor coating, so that, upon heating of the substrate, a coating film having a good strippability is formed under the scale inhibitor coating layer.

Upon heating in a heating furnace, a minor amount of oxygen diffusing through the scale inhibitor coating is allowed to reach the surface of the steel substrate, on which the oxygen reacts with Fe to form minor amounts of FeO, $Fe_3O_4$, $Fe_2O_3$, etc. while in many cases, Fe is allowed to react with the scale inhibitor, so that the strippability is furthermore deteriorated. But the sub-layer provided between the steel surface and the scale inhibitor coating when heated to 500° – 1100°C is melted, dissolving the oxides completely so that the melted coating layer formed between the steel surface and the scale inhibitor coating improves the strippability remarkably at the time of hot rolling.

Where the parting agent is soluble in water, for example, $B_4O_7^{--}$, it may be applied as is, while where the parting agent is hard-soluble in water, it may be applied in the form of dispersion in a binder. As the binder, use is made of water glass and water soluble resins, such as, CMC and PVA and the like. The amounts of the binder added is such that the minimum adhesion tension is obtained.

Preferred coating weights of the parting agent on steel surfaces are 0.01 – 2.5 mol/m². In the case of less than 0.01 mol/m², no effect results, and in the case of more than 2.5 mol/m², it often happens that the parting agent flows away, and, in an extreme case, it broke the scale inhibitor coating to flow out.

The above and follows data are obtained by using $Na_2B_4O_7$ as a parting agent. But almost similar results are effected when other compounds described above are employed.

Table 3

Effect of coating weights of $Na_2B_4O_7$ on the strippability at the time of heating at 1250°C.

| Coating weight (mol/m²) | 0.005 | 0.01 | 0.05 | 0.1 | 0.5 | 1.0 | 2.0 | 2.5 | 3.0 |
|---|---|---|---|---|---|---|---|---|---|
| Strippability | x | O | O | O | O | O | O | O | Δ |

Note 1)
O After passed through a scale breaker peeled off in 100%
Δ After passed through a scale breaker peeled off in 95 – 99%
x After passed through a scale breaker peeled off in less than 95%
Note 2)
Scale inhibitor $Cr_2O_3$-reducing agent-refractory-$SiO_2$-water glass The coating weight of the scale inhibitor is constant in all the samples.

Any scale inhibitor available on the market may be used, and its strippability is remarkably improved at the time of hot-rolling. Particularly with water glass-containing scale inhibitor compositions, for example, in a $Cr_2O_3$-chamottewater glass-metal powder-$SiO_2$ system, a remarkable improvement in the strippability is effected. Of course, the application of a subbing layer of such a parting agent does not damage the antioxidation effect of the scale inhibitor coating applied thereon.

Hitherto lower alloy steels, such as, 9 percent Ni steel and Cu-containing steel suffer from pockmark scars and brick scars at the time of hot rolling because an intimate scale layer which can be hardly peeled off is formed when heating in the heating furnace. Application of this invention to these lower alloy steels provides products having clean finish surfaces.

An experiment was conducted using a Cu-containing steel. One surface of a 0.5 percent Cu steel slab was divided into three parts, the center part of which was coated with an aqueous boron at a coverage of 0.25 mol/m², and then a scale inhibitor coating (in $Cr_2O_3$- reducing agent-refractory-$SiO_2$-water glass system) was applied thereon at a coverage of 3 kg/m². Another part was untreated (bar surface), and the other part was coated with the scale inhibitor composition described just above. After being dried, the slab having three different surfaces was heated at 1230°C for 5 hours in a heating surface and then rolled.

The rolling operation was performed in the procedure from a scale breaker step to a finish rolling step, while removing the scale by means of high pressure sprays of more than 100 atms before and after each of the scale breaker and finish rolling steps. In this experiment, after the slab had been passed through the scale breaker step, how the formed scale and the scale inhibitor coating had been peeled off was examined. As a result, some scale fragments were found to be left behind on the untreated part. On the other hand, on the scale inhibitor-coated surface, almost all of the scale inhibitor coating remained thereon. In contrast to these surfaces, it was found that both the under-coating and over-coating layers had been completely (100 percent) peeled off from the surface which had been treated according to the method of the invention.

In the next place, when the slab was subjected to the finish rolling, a great number of surface scars due to the insertion of scale fragments were formed and some cracks were found. On the surface coated with only the scale inhibitor, a number of brick scars due to the unremoved fragments of the scale inhibitor coating, are formed over the surface and further there were some fragments of the scale inhibitor coating adhered on the rolls.

In contrast to these surfaces, the part which is treated according to the method of the invention had no surface scar and was clean. The surface roughness was measured to find that the differences between the convex and concave portions fell in a range of less than 0.03mm.

As will be seen from this experiment, according to the invention, the scale inhibitor coating can be perfectly peeled off at the time of rolling. Therefore, the surface defects due to the unremoved fragments of the scale inhibitor coating, and a number of pockmarks due to the scale inhibitor fragments adhered on the rolls can be largely decreased, so that the cost necessary for finishing the surfaces of the metal substrates can be largely diminished.

The method of treatment using a third parting agent and the composition of the parting agent will be explained hereinbelow.

This phase of the invention relates to a method of treatment in which a mixture containing one or more refractories and clays dispersed in a binder is applied on the surfaces of substrates to be heated, and an overcoating of a scale inhibitor composition is applied thereon. When the substrate having a sub-layer formed by the method of the invention is heated, a thin coating film containing solid particles is formed under the scale inhibitor coating layer. The subbing layer containing said particles is fragile due to the action of the solid particles, and has a poor adhesive strength to the steel substrate, so that it is very easily peeled off by the subsequent rolling operation from the surfaces of the steel substrate together with the scale inhibitor coatings applied on the sub-layer. The application of the sub-layer does not damage the antioxidation effect of the scale inhibitor coating applied thereon. A more detailed explanation will be made hereinbelow.

As the refractory and clay incorporated in the third parting agent composition, use can be made of silica powder, magnesia powder, kaolin, montmorillonite and refractories of $MgO$-$Cr_2O_3$, $MgO$-$SiO_2$ and dolomite systems. Of these, kaolin (particularly chamotte clay powder), montmorillonite are the most preferable. The powders of one or more refractories and clays selected from the above are used in the form of dispersion in a binder. As the binder, use can be made of water glass, colloidal silica and colloidal silica mixed with minor amounts of $CrO_3$ and/or $Na_2Cr_2O_7$. When water glass is used as the binder, a tough coating film results after applied and dried. But the drying at ordinary temperature takes usually a long time. In order to shorten the drying time, colloidal silica is preferably used. However, the use of colloidal silica as the binder as compared with water glass, so that $CrO_3$ and/or $Na_2Cr_2O_7$ may be added to colloidal silica to avoid such a disadvantage.

Preferred formulations of the sub-layer composition and coating weights are described herebelow. Table 4 shows a relation of the mixture ratio of kaolin and water glass to the strippability of the sub-layer together with the scale inhibitor coating layer.

Table 4

Effect of the mixture ratio of kaolin and water glass on the strippability at the time of heating at 1250°C

| Kaolin:water glass (part by weight) | 10:0.1 | 10:0.5 | 10:1 | 10:2 | 10:5 | 10:10 | 10:15 | 10:20 |
|---|---|---|---|---|---|---|---|---|
| Strippability | O | O | O | O | O | O | Δ | x |

Note 1)
O After passed through a scale breaker peeled off in 100%
Δ After passed through a scale breaker peeled off in 95 – 99%
x After passed through a scale breaker peeled off in less than 95%
Note 2)
Coating weight of the subbing layer: 1 kg/m²
Scale inhibitor:
$Cr_2O_3$-reducing agent-refractory-$SiO_2$-water glass system
The coating weight of scale inhibitor is constant in all the samples.

As is clear from Table 4, the optimum mixture ratio is less than 10 parts of water glass per 10 parts of kaolin. This is because when the amount of water glass added exceeds 10 parts, the concentration of kaolin is so small that the adhesion strength between the sub-layer and steel substrate is increased, and simultaneously the toughness of the subbing layer is strengthened thereby. When the fraction of water glass is decreased from 0.1 part, the purpose of facilitating the coating of the composition on the steel substrate is not sufficiently achieved, although the good strippability is maintained.

Table 5

| Effect of coating weights on the strippability when heating at 1250°C | | | | | | | | | |
|---|---|---|---|---|---|---|---|---|---|
| Coating weight ($kg/m^2$) | 0.05 | 0.1 | 0.2 | 0.5 | 1.0 | 5.0 | 10.0 | 20.0 | 30.0 |
| Strippability | x | O | O | O | O | O | O | O | O |

Note 1)
The criterion to the strippability is the same as in Table 4.
Note 2)
The composition of the scale inhibitor and coating weights are the same as in Table 4.

As is clear from Table 5, good results are obtained with coating weights larger than 0.1 $kg/m^2$. When coating weights smaller than 0.1 $kg/m^2$ are employed, an insufficient isolation of the scale inhibitor coating from the steel substrate is effected. In Tables 4 and 5, the compositions formulated of kaolin and water glass are representative of the sub-layer. Similar results are effected by using other constituents.

Further the present inventors have discovered that although it is preferred that the scale inhibitor coating applied on a steel substrate in order to perform the heat treatment is dried at elevated temperatures for the purpose of shortening the drying time, the strippability of scale inhibitor coating is remarkably deteriorated by employing a high drying temperature. The present inventors have made attempts to remove the above-mentioned problem, and found that the strippability of the scale inhibitor coating is remarkably improved at the time of heating, provided that the scale inhibitor compositions containing water glass are applied and dried at temperatures below 70°C. Therefore, the final phase of the present invention relates to this finding.

Figure 5:
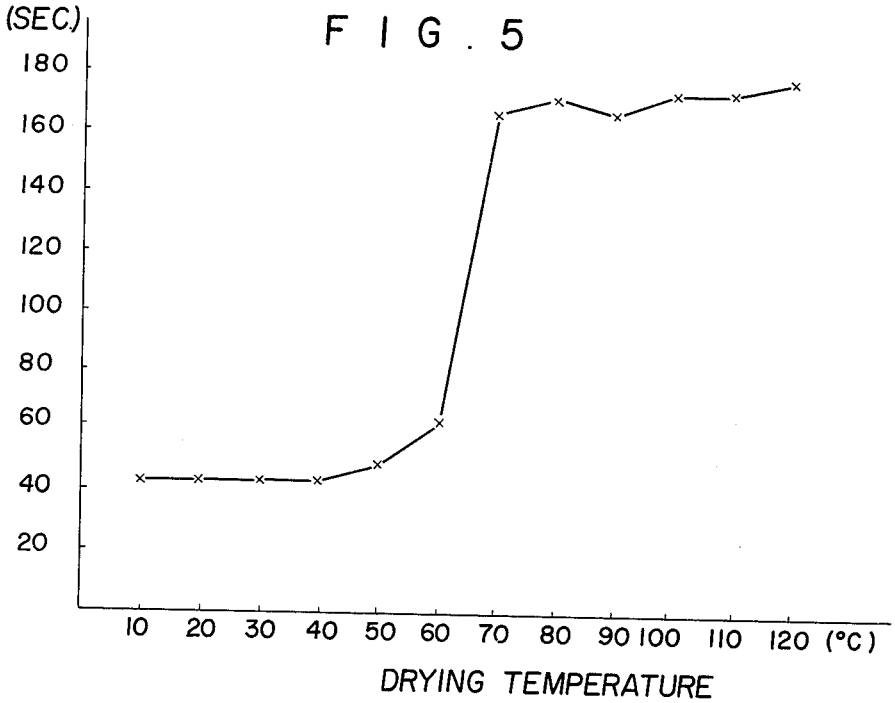
FIGS. 5 – 7 illustrate the strippability of the scale inhibitor coating used in conjunction with a parting agent composition of the invention after heating treatment.

In order to examine the drying temperature dependence of the strippability, one experiment was conducted, wherein a series of steel slabs were coated with a scale inhibitor composition containing water glass and dried at different temperatures. The steel slabs thus coated were heated at 1250°C for 4 hours, and then exposed to 20 atm. pressure water jets to measure the time necessary for the coating to be peeled off completely. FIG. 5 shows the relation of the peeling time to the drying temperatures. As is clear from the Table 5, the strippability depends largely upon the drying temperature. In other words, as the drying temperature is increased in order to shorten the drying time, the strippability of the scale inhibitor coating containing water glass is remarkably reduced. But when the drying temperatures are less than 70°C, a good strippability is effected.

Figure 6:
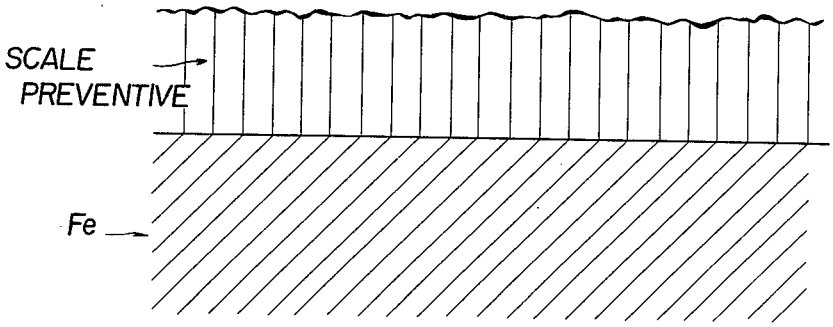

This reason may be considered as follows. FIG. 6 shows a sectional view of the scale inhibitor coating which after being applied was dried on heating at a temperatures below 70°C, while FIG. 7 shows a sectional view of the coating dried at temperature above 70°C.

Figure 7:
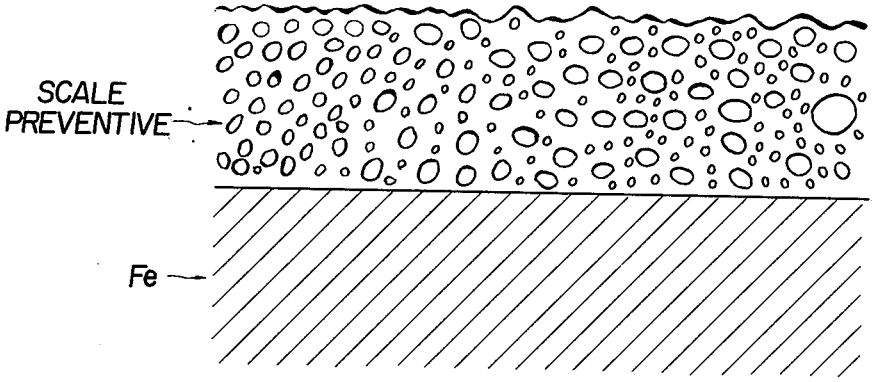

When the coating is dried at temperature above 70°C, the water glass contained in the scale inhibitor composition reacts with carbon dioxide contained in the air to form a shielding thin film on the surface of the coating, so that the water contained in the coating can not be evaporated off, forming bubbles as shown in FIG. 7. The cellular coating thus formed permits the $SiO_2$ present in the water glass and the iron monooxide formed by heating to high temperatures on the substrate surfaces to react readily with each other, so that a great amount of $2FeO.SiO_2$ is formed with the result of a flexible coating having poor strippability.

The strippability of the scale inhibitor coating containing water glass is attributable to the chemical reaction occurring at temperatures higher than 70°C, so that the surface temperature of steel substrates to be coated should be kept below 70°C.

As shown above, when scale inhibitor compositions containing water glass are employed, the strippability of the scale inhibitor coating at the time of heating is remarkably improved by carrying out the drying at temperatures less than 70°C.

In manufacturing the usual steel products, heated slabs are pressed through a scale breaker under a slightly elevated pressure and exposed to a high pressure water of 100 – 200 atoms. However, the scale inhibitor compositions containing water glass are applied and dried according to the invention are completely peeled off only by applying no pressure in the scale breaker and directing high pressure water having a pressure as low as several tens times that of atmospheric pressures thereto.

Example 1:

| | |
|---|---|
| $Cr_2O_3$ | 5 parts |
| Aluminum powder | 5 |
| Kaolin | 40 |
| $SiO_2$ | 40 |
| Water glass | 30 |
| Water | 40 |

The scale inhibitor composition formed by the mixture above was applied on a polished sheet substrate at a coverage of 2 $kg/m^2$, and then dried, at ordinary temperature. The substrate thus coated was heated to 1350°C and maintained at the temperature for 3 hours to examine the formation of scale, the weight loss of the steel being 5 $mg/cm^2$.

Example 2:

| | |
|---|---|
| $Cr_2O_3$ | 10 parts |
| Zn | 15 |
| Montmorillonite | 60 |
| $SiO_2$ | 20 |
| Water glass | 30 |
| Water | 60 |

A scale inhibitor composition formed by the mixture above was applied on a sheet substrate at a coverage of 1 $kg/m^2$ and dried in a 50°C atmosphere. The steel substrate thus coated was heated at 1000°C for 5 hours to examine the formation of scale, the weight loss of steel being 0.5 $mg/cm^2$.

Example 3:

| | |
|---|---|
| $Cr_2O_3$ | 10 parts |
| Aluminum powder | 3 |
| Chamotte | 60 |
| $SiO_2$ | 35 |
| Water glass | 30 |
| Water | 30 |

A scale inhibitor composition formed by the mixture above was applied on a polished steel substrate at a coverage of 1.5 $kg/m^2$ and dried at ordinary temperature. The substrate thus coated was heated at 1350°C for 4 to examine the formation of scale, the weight loss of steel being 6 $mg/cm^2$. 2.

Example 4:

| | |
|---|---|
| $Cr_2O_3$ | 15 parts |
| Kaolin | 50 |
| Aluminum powder | 10 |
| Water glass | 40 |
| Water | 40 |
| $SiO_2$ | 60 |
| Bentonite | 2 |

A scale inhibitor composition formed by the mixture above was applied on a steel substrate at a coverage of 3 kg/m² and dried in a 80°C. The substrate was heated at 1400°C for 4 hours to examine the formation of scale, the weight of loss of steel being 12 mg/cm².

Example 5:

| | |
|---|---|
| $Cr_2O_3$ | 10 parts |
| Kaolin | 40 |
| Zn | 5 |
| $SiO_2$ | 30 |
| Water glass | 40 |
| Water | 40 |

A scale inhibitor composition formed by the mixture above was applied on an aluminum substrate at a coverage of 1.5 kg/m² and dried in a 80°C atmosphere. The aluminum substrate thus coated was heated at 600°C for 50 hours to examine the weight loss of aluminum due to the formation of aluminum oxide was measured being 1.5 mg/cm².

EXAMPLE A (FOR COMPARISON)

A scale inhibitor available on the market is applied on a steel substrate at a coverage of 3 kg/m² and dried at ordinary temperature. Thus substrate was heated at 1000°C for 3 hours to examine the formation of scale, the weight loss of the steel being 240 mg/cm².

EXAMPLE B (FOR COMPARISON)

A scale inhibitor available on the market was applied on a steel substrate at a coverage of 4 kg/m² and dried at in a 60°C atmosphere. The substrate was heated at 1200°C for 4 hours to examine the formation of scale, the weight loss of the steel being 580 mg/m².

EXAMPLE C (FOR COMPARISON)

A steel substrate having no coating was heated at 1280°C for 4 hours to examine the formation of scale, the weight loss of the steel being 1500 mg/cm².

EXAMPLE 6

A slab for thick plate was coated with a mixture containing 10 parts of $BaC0_3$ and 4 parts of water glass in a coating weight of 0.5 kg/m², and then overcoated with a scale inhibitor composition in a $Cr_20_3$-Al-kaolin-$SiO_2$-water glass system at a coating weight of 2 kg/m². After being dried, the slab was heated in a heating furnace at 1250°C for 35 hours and then rolled. Results are shown in Table 6.

EXAMPLE 7

A slab for thick plane was coated with a mixture containing 10 parts of Ba0 and 5 parts of water glass in a coating weight of 1 kg/m², and then over-coated with a scale inhibitor in a $Cr_20_7$-Zn-montmorillonite-$SiO_2$-water glass at a coating weight of 2.5 kg/m². After being dried, the slab was heated in a heating furnace in 1300°C for 2 hours, and then rolled. Results are shown in Table 6.

EXAMPLE 8

A beam blank for H specimen steel was coated with a mixture containing 10 parts of Ba, 3 parts of colloidal silica and 0.1 parts of $Cr0_3$ at a coating weight of 2 kg/m² and then over-coated thereon with a scale inhibitor in $Cr_20_3$-Al powder-chamotte-$Si0_2$-water glass system in a coating weight of 1.5 kg/m². After being dried, the steel substrate was heated in a heating furnace at 1200°C for 3 hours and then rolled. Results are shown in Table 6.

EXAMPLE 9

A slab for hot coil was coated with a mixture containing 10 parts of Ti and 3 parts of water glass at a coating weight of 4 kg/m², and over-coated thereon with a scale inhibitor in $Cr_20_3$-kaolin-Zn-$SiO_2$-water glass system in a coating weight of 1.5 kg/m². After being dried, the slab was heated in a heating furnace at 1280°C for 5 hours, and then rolled. Results are shown in Table 6.

EXAMPLE 10

A slab for thick plate was coated with a mixture containing 10 parts of CaO and 3 parts of glass water at a coating weight of 1.0 kg/m², and then over-coated thereon with a scale inhibitor of $Cr_2O_3$Cu-kaolin-$SiO_2$-water glass in a coating weight of 1.5 kg/m². After being dried, the slab was heated in a heating furnace at 1300°C for 3 hours, then rolled. Results are shown in Table 6.

EXAMPLE 11

A slab for thick plate was coated with a mixture containing 5 parts of $P_2O_5$, 5 parts of $K_2O$ and 5 parts of water glass in a coating weight of 1.5 kg/m², and then over-coated with scale inhibitor of $Cr_2O_3$Al-chamotte-$SiO_2$-water glass system at a coating weight of 3 kg/m². After being dried, the slab was heated in a heating furnace at 1400°C for 2 hours, and then rolled. Results are shown in Table 6.

EXAMPLE 12

A beam blank for steel plate was coated with a mixture containing 10 parts of $Na_2O$ and 2 parts of water glass in a coating weight of 1.5 kg/m², and then over-coated thereon with a scale inhibitor in a $Cr_2O_2$-Al powder-chamotte-$SiO_2$-water glass system at a coating weight of 2 kg/m². After being dried, the beam blank was heated in a heating furnace at 1150°C for 5 hours, and then rolled. Results are shown in Table 6.

EXAMPLE 13

A slab for hot coil was coated with a mixture containing 10 parts of CuO and 5 parts of water glass at a coating weight of 0.3 kg/m² and then over-coated with a scale inhibitor in a $Cr_2O_3$-chamotte-Zn powder-$SiO_2$-water glass system in a coating weight of 1.0 kg/m². After being dried, the slab was heated in a heating furnace at 1180°C for 6 hours, and then rolled. Results are shown in Table 6.

EXAMPLE 14

A beam blank for H specimen steel was coated with a mixture containing 3 parts of CoO and 5 parts of $SiO_2$ and 0.5 part of CMC in a coating weight of 0.5 kg/m², and then over-coated with a scale inhibitor in a $Cr_2O_3$-

Al-chamotte-$SiO_2$-water glass system at a coating weight of 3 kg/m². After being dried, the beam blank was heated in a heating furnace at 1380°C for 4 hours, and then rolled. Results are shown in Table 6.

EXAMPLE D (FOR CONVENTIONAL CASE)

A scale inhibitor available on the market was applied directly. Results are shown in Table 6.

EXAMPLE 15

A slab for thick plate was coated with boron dissolved in water heated to 90°C by spray coating at a coverage of 0.1 mol/m², and then over-coated with a scale inhibitor composition in $Cr_2O_3$-Al-kaolin-$SiO_2$-water glass system at a coverage of 3 kg/m². After being dried, the slab was heated in a heating furnace at 1250°C for 6 hours, and then rolled. Results are shown in Table 6.

EXAMPLE 16

A 0.3% Cu-containing slab for thick plate was coated with $K_2B_4O_7$ mixed with a minor amount of water glass at a coverage of 0.2 mol/m², and then over-coated with a scale inhibitor composition in a $Cr_2O_3$-Fe-chamotte-$SiO_2$-water glass system at a coverage of 4 kg/m². After being dried, the slab was heated in a heating furnace at 1220°C for 5 hours and then rolled. Results are shown in Table 6.

EXAMPLE 17

A beam blank for H specimen steel was coated with $Na_2P_2O_7$ mixed with a minor amount of water soluble resin (PVA) at a coverage of 0.25 mol/m² and then over-coated with a scale inhibitor composition in a $Cr_2O_3$-Zn-montmorillonite-$SiO_2$-water glass system at a coverage of 2.5 kg/m². After being dried, the beam blank was heated in a heating furnace at 1200°C for 2.5 hours, and then rolled. Results are shown in Table 6.

EXAMPLE 18

A slab for hot coil was coated with $Na_2S_2O_7$ mixed with a minor amount of water glass at a coverage of 0.1 mol/m² and then over-coated with a scale inhibitor composition in a $Cr_2O_3$-chamotte-Al-$SiO_2$-water glass system at a coverage of 3 kg/m². After being dried, the slab was heated in a heating furnace at 1290°C for 4 hours. Results are shown in Table 6.

EXAMPLE 19 bloom EXAMPLE for unequal-sided specimen steel was coated with $NaH_2PO_4$ mixed with a minor amount of CMC at a coverage of 1.5 mol/m², and then over-coated with a scale inhibitor composition in a $Cr_2O_3$-chamotte-Pb-$SiO_2$-water glass system at a coverage of 4 kg/m². After being dried, the bloom was heated in a heating furnace at 1240°C for 3 hours and then rolled. Results are shown in Table 6.

EXAMPLE 20

A slab for thick plate was coated with $H_3BO_3$ at a coverage of 2.0 mol/m², and then over-coated with a scale inhibitor composition in a $Cr_2O_3$-Al-chamotte-$SiO_2$-water glass system at a coverage of 4 kg/m². The slab thus coated was heated in a heating furnace at 1350°C for 2.5 hours. Results are shown in Table 6.

EXAMPLE 21

A beam blank for steel plate was coated with $K_2B_4O_7.10H_2O$ dissolved in 95°C water by the spray coating at a coverage of 1.7 mol/m² and then over-coated with a scale inhibitor composition in a $Cr_2O_3$-Sn powder-chamotte-$SiO_2$-water glass at a coverage of 2.5 kg/m². After being dried, the beam blank was heated in a heating furnace at 1170°C for 5 hours and then rolled. Results are shown in Table 6.

EXAMPLE 22

A 9 percent Ni steel slab was coated with $B_2O_3$ mixed with a minor amount of a water soluble resin at a coverage of 0.5 mol/m² and then over-coated with a scale inhibitor composition in a $Cr_2O_3$-kaolin-Cu powder-$SiO_2$-water glass system at a coverage of 5 kg/m². After being dried, the slab was heated in a heating furnace at 1190°C for 7 hours and then rolled. Results are shown in Table 6.

EXAMPLE 23

A slab for thick plate was coated with a mixture of $Na_2B_4O_7$ and $Na_2P_2O_7$ (1 : 1) dissolved in hot water at a coverage of 0.4 mol/m², and then over-coated with a scale inhibitor composition in a $Cr_2O_3$-chamotte-Al-$SiO_2$ water glass system at a coverage of 3.5 kg/m². After being dried, the slab was heated in a heating furnace at 1230°C for 4.5 hours and then rolled. Results are shown in Table 6.

EXAMPLE 24

A slab for thick plate was coated with $Na_2B_4O_7$ dissolved in hot water at a coverage of 0.25 mol/m² and then over-coated with a scale inhibitor available on the market at a coverage of 5 kg/m². After being dried, the slab was heated in a heating furnace at 1250°C for 4 hours and then rolled. Results are shown in Table 6.

EXAMPLE E (CONVENTIONAL CASE)

A scale inhibitor available on the market was directly applied. Results are shown in Table 6.

Table 6

Results of Present Invention and Conventional Methods

| | Separativity of Scale Preventives | Pock-mark Scars | Brick Scars | Scaling |
|---|---|---|---|---|
| Example 6 | After scale breaking 100% separation | no | no | 5 mg/cm² |
| Example 7 | " | no | no | 0.5 mg/cm² |
| Example 8 | After one pass of Rough Rolling 100% separation | no | no | 6 mg/cm² |
| Example 9 | After scale breaking 100% separation | no | no | 12 mg/cm² |

Table 6-continued

| Results of Present Invention and Conventional Methods | | | | | |
|---|---|---|---|---|---|
| | Separativity of Scale Preventives | Pock-mark Scars | Brick Scars | Scaling | |
| Example 10 | " | no | no | 1 | mg/cm² |
| Example 11 | " | no | no | 7 | mg/cm² |
| Example 12 | After one pass of rough rolling 100% separation | no | no | 0.9 | mg/cm² |
| Example 13 | " | no | no | 4 | mg/cm² |
| Example 14 | " | no | no | 2 | mg/cm² |
| Conventional | After completion of rolling 60–70% remained After shot blasting partly remained | yes | yes | 5 | mg/cm² |
| Comparative | Non-treated (naked) slab was heated at 1280°C for 4 hrs. | | | 1500 | mg/cm² |
| Example 15 | After scale breaking 100% separation | no | no | 3 | mg/cm² |
| Example 16 | " | no | no | 2 | mg/cm² |
| Example 17 | " | no | no | 0.5 | mg/cm² |
| Example 18 | After one pass 100% separation | no | no | 3 | mg/cm² |
| Example 19 | After scale breaking 100% separation | no | no | 0.3 | mg/cm² |
| Example 20 | " | no | no | 7 | mg/cm² |
| Example 21 | " | no | no | 0.2 | mg/cm² |
| Example 22 | " | no | no | 0.8 | mg/cm² |
| Example 23 | " | no | no | 3 | mg/cm² |
| Example 24 | " | no | no | 130 | mg/cm² |
| Conventional | After completion of rolling 60–70% remained After shot blasting partly remained | yes | yes | 150 | mg/cm² |
| Comparative | Non-treated (naked) slab was heated at 1280°C for 4 hrs. | | | 1500 | mg/cm² |

EXAMPLE 25

A slab for thick plate was coated with a mixture containing 10 parts of chamotte and 4 parts of water glass at a coverage of 0.5 kg/m² and then over-coated with a scale inhibitor composition in a $Cr_2O_3$-Al-kaolin-$SiO_2$-water glass system at a coverage of 2 kg/cm². After being dried, the slab was heated in a heating furnace at 1250°C for 5 hours, and then rolled. Results are shown in Table 7.

EXAMPLE 26

A slab for thick plate was coated with a mixture containing 10 parts of magnesia powder and 5 parts of water glass at a coverage of 1 kg/m², and then over-coated with a scale inhibitor composition in a $Cr_2O_3$-Zn-montmorillonite-$SiO_2$-water glass at a coverage of 3.5 kg/m². After being dried, the slab was heated in a heating furnace at 1300°C for 2 hours and then rolled. Results are shown in Table 7.

EXAMPLE 27

A beam blank for H specimen steel was coated with a mixture containing 10 parts of montmorillonite, 3 parts of colloidal silica and 0.3 part of $CrO_3$ at a coverage of 2 kg/m² and the over-coated with a scale inhibitor composition in a $Cr_2O_3$-Al powder-chamotte-$SiO_2$-water glass system at a coverage of 2.5 kg/m². After being dried, the slab was heated in a heating furnace at 1200°C for 3 hours and then rolled. Results are shown in Table 7.

EXAMPLE 28

A slab for hot coil was heated with a mixture containing 10 parts of $Fe_2O_3$, and 3 parts of water glass at a coverage of 4 kg/m² and then over-coated with a scale inhibitor composition in a $Cr_2O_3$-kaolin-Zn-$SiO_2$-water glass system at a coverage of 2.8 kg/m². After being dried, the slab was heated in a heating furnace at 1280°C for 5 hours and then rolled. Results are shown in Table 7.

CONVENTIONAL EXAMPLE

A slab was directly coated with a scale inhibitor composition similar to that used in Example 25, and then dried. The slab was heated in a heating furnace at 1280°C for 4 hours and then rolled. Results are shown in Table 7.

Table 7

| Results of Present Invention and Conventional Methods | | | | | |
|---|---|---|---|---|---|
| | Separativity of Scale Preventives | Pock-mark Scars | Brick Scars | Scaling | |
| Example 25 | After scale breaking 100% separation | no | no | 5 | mg/cm² |
| Example 26 | " | no | no | 0.5 | mg/cm² |
| Example 27 | After one pass of rough rolling 100% separation | no | no | 6 | mg/cm² |
| Example 28 | After scale breaking 100% separation | no | no | 12 | mg/cm² |
| Conventional | After completion of rolling 60–70% remained After shot blasting partly remained | yes | yes | 5 | mg/cm² |
| Comparative | Non-treated (naked) slab was heated at 1280°C for 4 hrs. | | | 1500 | mg/cm² |

EXAMPLE 29

A slab for conventional steel with a surface temperature of 50°C was coated with a scale inhibitor composition in a $Cr_2O_3$-chamotte-water glass-Al-$SiO_2$ system at a coverage of 4 kg/m². After being dried in a 50°C atmosphere (for 3 hours), the slab was heated in a heating furnace at 1250°C for 4 hours and then rolled. When the slab was passed through a scale breaker under 10mmHg pressure and 100 atm. pressure water, more than 90 percent of the scale inhibitor coating was peeled off. In the first pass in the subsequent finish-rolling step, the residual of the scale inhibitor coating was completely peeled off.

When the surface temperature of a slab was 90°C, and the drying temperature was 90°C (for 30 minutes), 30 percent of the scale inhibitor coating was peeled off.

EXAMPLE 30

A beam blank for H specimen steel with a surface temperature of 30°C was coated with a scale inhibitor composition in a $Cr_2O_3$-montmorillonite-water glass-Zn-$SiO_2$ system at a coverage of 3 kg/m². After being dried in a 60°C atmosphere (for 2.5 hours), the slab was heated in a heating furnace at 1280°C for 2.5 hours, and then hot-rolled, while applying a pressure by means of a scale breaker and a high pressure water of 100 atms. 100 percent of the scale inhibitor coating was peeled off in three passes.

EXAMPLE 31

A slab for usual steel with a surface temperature of 40°C was under-coated with a mixture containing $BaCO_3$-water glass at a coverage of 0.1 kg/m². After being dried by standing, a scale inhibitor composition in a $Cr_2O_3$-kaolin-water glass-Fe-$SiO_2$ system was applied at a coverage of 3.5 kg/m² on the under-coating. After being dried in a 55°C atmosphere (for 2.5 hours), the slab was heated in a heating furnace at 1230°C for 5 hours and then hot-rolled while applying no pressure on a scale breaker and a water spray of 20 atms. 100 percent of the scale inhibitor coating was instantaneously peeled off.

When a slab with a surface temperature of 100°C was used, and when the drying temperature was 80°C (for 30 minutes), although the strippability was improved by the provision of the subbing layer, nevertheless 5 percent of the scale inhibitor coating was left behind even when applying a 10mmHg pressure on a scale breaker and a high pressure water of 100 atms.

What is claimed is:

1. A scale preventive composition consisting essentially of 1 to 20 wt. parts of $Cr_2O_3$, 1 to 20 wt. parts of one or more of Al, Zn, Cu, Ni, Co, Mn, Mg, Fe, Cr, Ti, Zr, Sr, Mo, Sn, In, C, $Fe_3O_4$ and FeO, 5 – 80 wt. parts of one or more of silica powder, porcelain, magnesia powder, montmorillonite, Mg-$Cr_2O_3$ and MgO-$SiO_2$ and dolomite refractories or clay 5 to 120 wt. parts of $SiO_2$ and 5 to 120 wt. parts of water glass.

2. A scale preventive composition according to claim 1 in which the ratio of $Na_2O$ in the water glass to total $SiO_2$ is 0.005 to 0.3 : 1.

3. The composition of claim 1 wherein, in addition to any other clay, 0.5 to 5 weight parts of bentonite is present.

* * * * *